US011020977B2

(12) United States Patent
Matsumoto

(10) Patent No.: US 11,020,977 B2
(45) Date of Patent: Jun. 1, 2021

(54) PRINTER AND METHOD FOR CONTROLLING PRINTER

(71) Applicant: SEIKO EPSON CORPORATION, Tokyo (JP)

(72) Inventor: Kenji Matsumoto, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/750,045

(22) Filed: Jan. 23, 2020

(65) Prior Publication Data

US 2020/0238721 A1 Jul. 30, 2020

(30) Foreign Application Priority Data

Jan. 24, 2019 (JP) ..... JP2019-009994

(51) Int. Cl.
*B41J 2/175* (2006.01)

(52) U.S. Cl.
CPC ..... *B41J 2/17546* (2013.01)

(58) Field of Classification Search
CPC ..... B41J 2/175; B41J 2/1752; B41J 2/17526; B41J 2/17546; B41J 2/17543; B41J 2029/3937
See application file for complete search history.

(56) References Cited

U.S. PATENT DOCUMENTS

2003/0214546 A1* 11/2003 Hatasa ..... B41J 2/17513 347/19
2007/0252858 A1* 11/2007 Kyoshima ..... B41J 2/17546 347/7

FOREIGN PATENT DOCUMENTS

| | | |
|---|---|---|
| JP | 2006-198774 | 8/2006 |
| JP | 2007-118339 | 5/2007 |
| JP | 2017-056651 | 3/2017 |

* cited by examiner

*Primary Examiner* — Scott A Richmond
(74) *Attorney, Agent, or Firm* — Workman Nydegger

(57) ABSTRACT

A printer includes an ink cartridge holding unit that holds a plurality of ink cartridges each including an ink pack and an IC chip that stores ink information, and an access unit that performs wireless communication with the IC chip of the ink cartridges held by the ink cartridge holding unit, and a printer controller, in which the IC chip stores a chip ID, and the printer controller acquires the chip ID from the IC chip of each of the plurality of ink cartridges, and executes, based on the chip ID that is acquired, processing related to the ink information with the IC chip of each of the plurality of ink cartridges.

5 Claims, 9 Drawing Sheets

PRINTER AND METHOD FOR CONTROLLING PRINTER

The present application is based on, and claims priority from JP Application Serial Number 2019-009994, filed Jan. 24, 2019, the disclosure of which is hereby incorporated by reference herein in its entirety.

BACKGROUND

1. Technical Field

The present disclosure relates to a printer and a method for controlling the printer.

2. Related Art

In the related art, there is known an ink cartridge including information storage medium configured to store ink information about ink. For example, JP 2017-56651 A discloses a printer, in which an ink cartridge having an IC chip as an information storage medium is loaded, communicating with the IC chip to write ink information indicating consumption amount of ink of the ink cartridge in the IC chip.

An ink cartridge such as that described in JP 2017-56651 A may include an information storage medium configured to perform wireless communication in a non-contact manner with the printer. When a printer includes a plurality of ink cartridges of this type, the printer may perform wireless communication with a wrong information storage medium that is not to be processed, and may execute processing related to ink information with the wrong information storage medium.

SUMMARY

One aspect for resolving the above-described issue provides a printer including an ink cartridge holding unit configured to hold a plurality of ink cartridges each including an ink storage section configured to store an ink and an information storage medium configured to store ink information about the ink stored in the ink storage section, a wireless communication unit configured to perform wireless communication in a non-contact manner with the information storage medium of the ink cartridge held by the ink cartridge holding unit, and a controller configured to control the wireless communication unit, in which the information storage medium is configured to store identification information that identifies the information storage medium, and the controller is configured to acquire, via the wireless communication unit, the identification information from the information storage medium of each of the plurality of ink cartridges held by the ink cartridge holding unit, and to execute, based on the identification information that is acquired, processing related to the ink information to the information storage medium of each of the plurality of ink cartridges via the wireless communication unit.

In the printer, the controller may be configured to perform, when acquiring the identification information from the information storage medium of each of the plurality of ink cartridges, wireless communication with the information storage media one by one via the wireless communication unit.

The printer may include a wireless communication blocking unit configured to block wireless communication between the wireless communication unit and the information storage medium, in which the controller may be configured to cause, when acquiring the identification information from the information storage medium, the wireless communication blocking unit to block wireless communication between the information storage medium other than an information storage medium from which the identification information is to be acquired and the wireless communication unit.

The printer may include a carriage configured to move in a cross direction crossing a transport direction in which a print medium is transported, in which the carriage may be provided with the ink cartridge holding unit, the ink cartridge holding unit holds a plurality of ink cartridges aligned in the cross direction, and in which the controller may be configured to cause, when acquiring the identification information from the information storage medium, the carriage to move, and to acquire the identification information from the information storage medium of the ink cartridge that moved along with movement of the carriage to a position that allows for wireless communication with the wireless communication unit.

Another aspect for resolving the above-described issue is a method for controlling a printer, the printer including an ink cartridge holding unit configured to hold a plurality of ink cartridges each including an ink storage section configured to store an ink and an information storage medium configured to store ink information about the ink stored in the ink storage section, a wireless communication unit configured to perform wireless communication in a non-contact manner with the information storage medium of the ink cartridge held by the ink cartridge holding unit, and a controller configured to control the wireless communication unit, in which the information storage medium stores identification information that identifies the information storage medium, and the controller acquires the identification information from the information storage medium of each of the plurality of ink cartridges held by the ink cartridge holding unit via the wireless communication unit, and executes, based on the identification information that is acquired, processing related to the ink information to the information storage medium of each of the plurality of ink cartridges via the wireless communication unit.

DESCRIPTION OF EXEMPLARY EMBODIMENTS

First Embodiment

Figure 1:
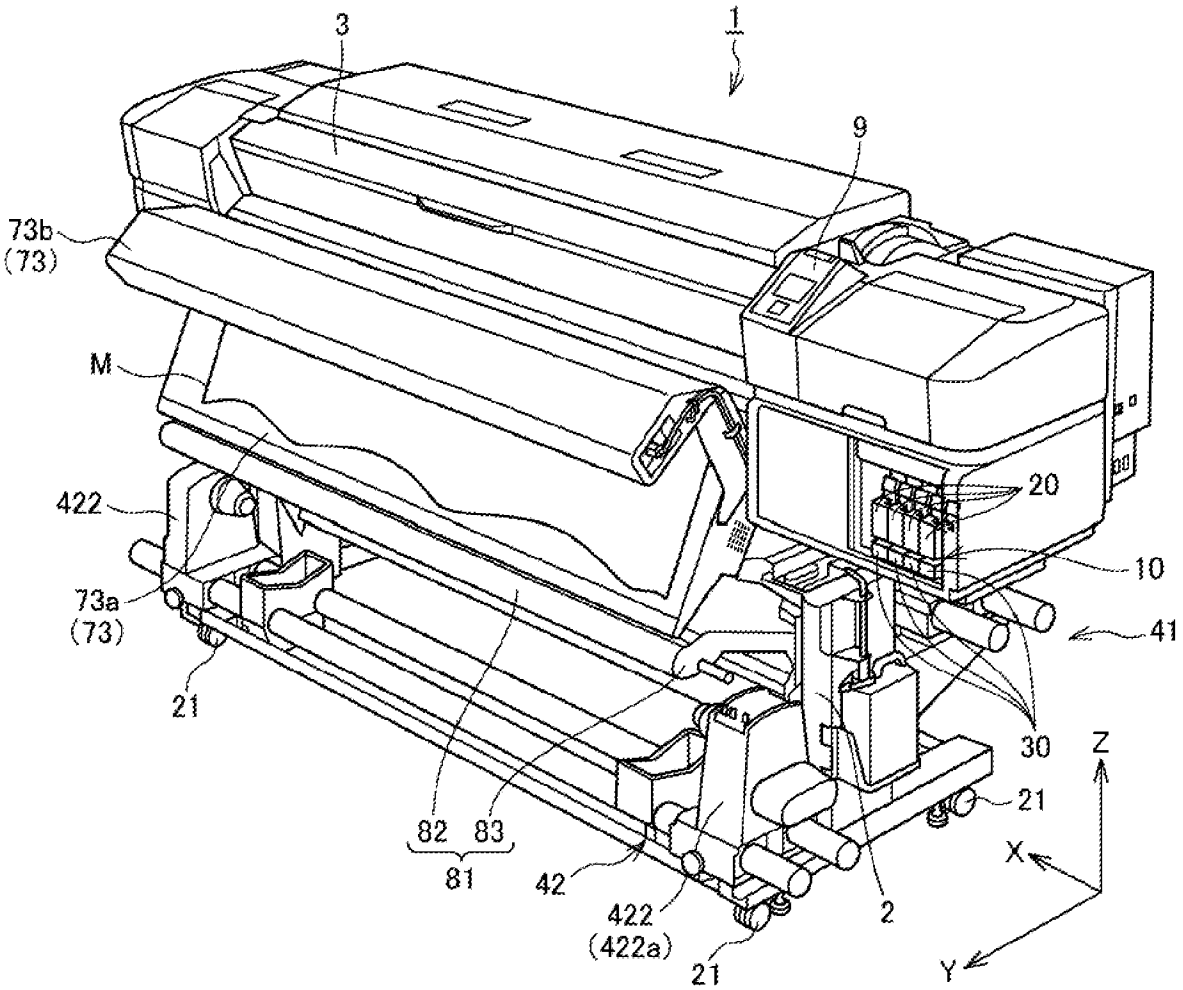
FIG. 1 is an external perspective view illustrating a printer according to a first embodiment.
Figure 2:
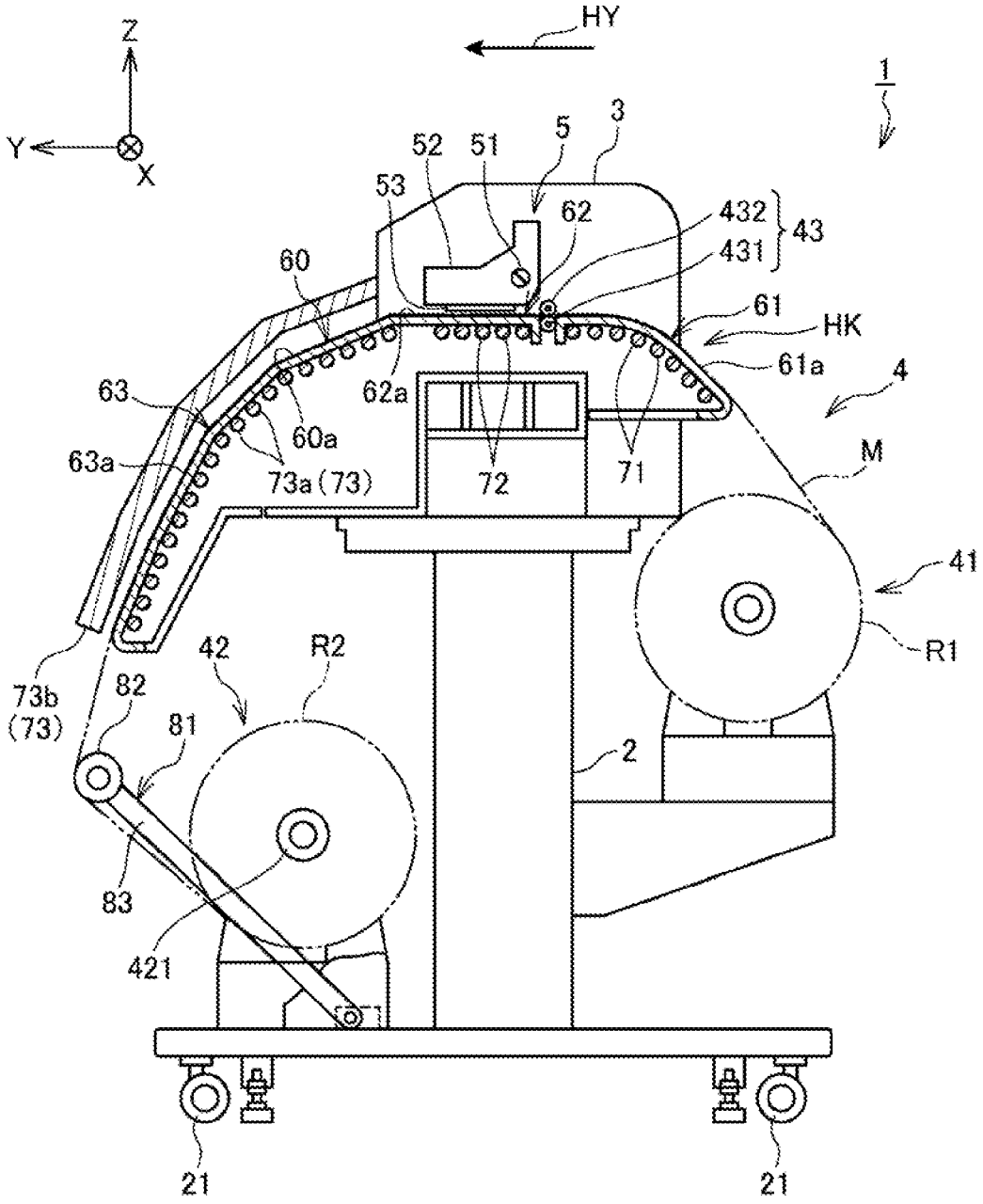
FIG. 2 is a cross-sectional view illustrating an internal configuration of a printer.

Hereinafter, a first embodiment is described with reference to the accompanying drawings. In FIG. 1, FIG. 2, FIG.

Figure 4:
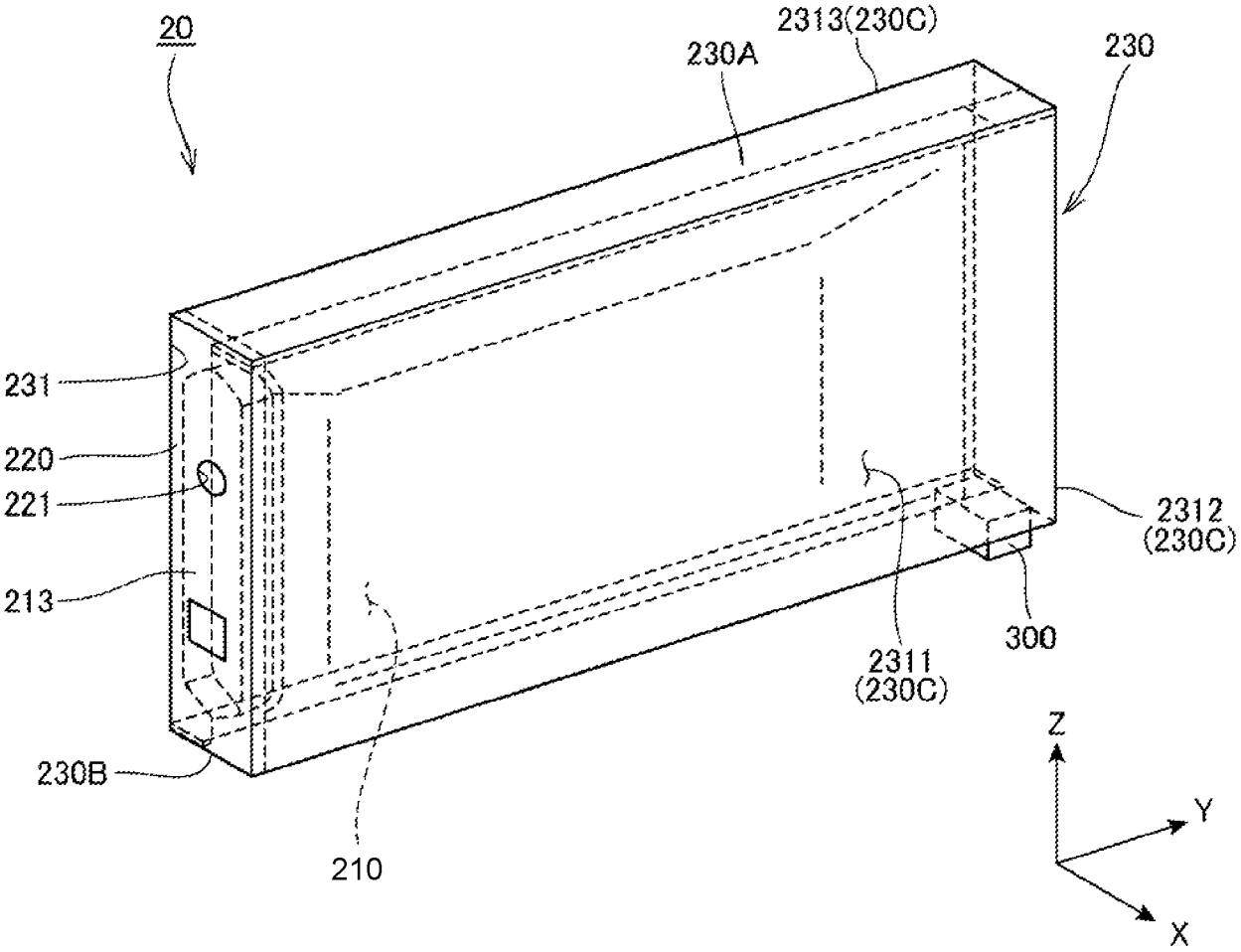
FIG. 4 is an external perspective view schematically illustrating a configuration of an ink cartridge.

3, and FIG. 4, an X-axis, a Y-axis, and a Z-axis are illustrated as three axes perpendicular to one another, for convenience of explanation. Each of the arrows indicating an axial direction has a tip end side as a plus side and a base end side as a minus side.

In each of FIG. 1, FIG. 2, FIG. 3, and FIG. 4, a Z axis direction, which is a direction parallel to the Z-axis, indicates a vertical direction. Hereinafter, the direction toward the plus side in the Z-axis direction is referred to as upward, and the direction toward the minus side in the Z-axis direction is referred to as downward. An X-axis direction, which is a direction parallel to the X-axis, is a horizontal direction. hereinafter, the direction toward the plus side in the X-axis direction is referred to as leftward, and the direction toward the minus side in the X-axis direction is referred to as rightward. A Y-axis direction, which is a direction parallel to the Y-axis, is a front-back direction. Hereinafter, the direction toward the plus side in the Y-axis direction is referred to as frontward, and the direction toward the minus side in the Y-axis direction is referred to as backward.

FIG. 1 is an external perspective view illustrating a printer 1. FIG. 2 is a cross-sectional view illustrating an internal configuration of the printer 1.

The printer 1 is a printing apparatus configured to discharge an ink in an ink-jet scheme onto a print medium M to print an image on a print surface of the print medium M, and is a large format printer configured to perform printing onto the print medium M having a relatively large size.

As the print medium M, high-quality paper, cast paper, art paper, coat paper, synthetic paper, or a film, cloth, or the like composed of polyethylene terephthalate (PET), polypropylene (PP) or the like can be used, for example.

As illustrated in FIG. 2, the printer 1 includes a transport unit 4. The transport unit 4 is supported by a pedestal 2 including a plurality of casters 21 at the lower ends.

The transport unit 4 includes a feeding section 41 configured to feed the print medium M to a body 3 from a roll body R1 that the print medium M having an elongated size is wound in a roll shape, and a winding section 42 configured to wind the print medium M onto which printing has been performed, the print medium M having been fed from a discharge port at the front of the body 3 by the feeding section 41. The transport unit 4 is configured to transport, when printing is performed, the print medium M in a transport direction HY in a roll-to-roll scheme with the feeding section 41 and the winding section 42. The transport direction HY corresponds to the frontward from the printer 1.

The feeding section 41 is provided backward from the body 3 having a substantially rectangular parallelepiped shape that is supported by the pedestal 2. The feeding section 41 is loaded with the roll body R1 in a replaceable manner. The feeding section 41 is configured to rotate the roll body R1 counterclockwise in FIG. 2 to unwind the print medium M from the roll body R1, to supply the print medium M to a printing unit 5.

The winding section 42 is provided frontward from the body 3. The winding section 42 includes a pair of holders 422 that clamp and support a winding roller 421 for forming a roll body R2. A holder 422*a* of the holders 422 is provided with a mechanism such as a motor that causes the winding roller 421 to rotate. The winding section 42 causes the winding roller 421 to rotate counterclockwise in FIG. 2, to wind up the print medium M onto which printing has been performed around the winding roller 421 to form the roll body R2.

As illustrated in FIG. 2, the transport unit 4 includes a transport roller pair 43 configured to transport the print medium M in the transport direction HY clamping the print medium M in a transport path HK between the feeding section 41 and the winding section 42. The transport roller pair 43 includes a transport driving roller 431 for rotational driving disposed downward of the transport path HK, and a transport driven roller 432, disposed upward of the transport path HK, rotationally driven by the rotation of the transport driving roller 431. The transport driven roller 432 is configured to be movable in the vertical direction with respect to the transport driving roller 431. The transport roller pair 43 transports the print medium M in the transport direction HY by the transport driving roller 431 and the transport driven roller 432 clamping the print medium M.

The printer 1 includes, frontward from the transport roller pair 43 inside the body 3, the printing unit 5 configured to discharge an ink onto the print medium M to print an image onto the print surface of the print medium M.

The printing unit 5 includes a carriage 52 configured to move reciprocatively in a cross direction KY crossing the transport direction HY in which the print medium M is transported along a guide shaft 51 installed inside the body 3 that is supported by the pedestal 2. The guide shaft 51 is installed extending in the vertical direction of the printer 1. Accordingly, the carriage 52 moves reciprocatively in the horizontal direction of the printer 1.

The carriage 52 is mounted with an ink jet head 53. Note that the carriage 52 may be mounted with various devices in addition to the ink jet head 53.

The ink jet head 53 includes a plurality of nozzle rows aligned in the cross direction KY crossing the transport direction, where in each of the plurality of nozzle rows, a plurality of nozzles configured to discharge an ink are aligned in the transport direction HY at a face facing the print surface of the print medium M. The ink jet head 53 of the first embodiment includes four nozzle rows corresponding to four colors of cyan (C), magenta (M), yellow (Y), and black (K), respectively, to discharge an ink of the four colors.

The ink jet head 53 is configured to discharge an ink onto the print surface of the print medium M, where the ink is supplied from an ink cartridge 20 held by an ink cartridge holding unit 10 to the ink jet head 53. The ink cartridge holding unit 10 and the ink cartridge 20 will be described later in detail.

Note that the ink discharged from the ink jet head 53 is not limited to the ink of the colors described above, and may be, for example, ink of colors such as light cyan, light magenta, orange, green, gray, light gray, white, and metallic. Moreover, a liquid discharged from the ink jet head 53 may be a liquid other than an ink such as a pre-coating liquid without being limited to an ink.

As illustrated in FIG. 2, between the feeding section 41 and the winding section 42, a support member 60 having a support face 60*a* that supports the print medium M to be convex upward is provided. The support member 60 is constituted by assembling a plurality of members having a prescribed shape, the member being formed by a bending processing of a plate material made of sheet metal or the like.

The support member 60 includes a feeding support section 61 that supports the print medium M fed out from the roll body R1 at a position rearward from the printing unit 5, a printing support section 62 provided at a position facing the printing unit 5 to support a portion that serves as a part to become a print region of the print medium M, and a discharging support section 63 that supports the print medium M onto which printing has been performed at a position forward from the printing unit 5.

The feeding support section 61 includes a support face 61*a* including an inclined transport face increases height as approaching forward, which forms the transport path HK between the feeding section 41 and the printing unit 5. The print medium M fed out from the roll body R1 is transported to the printing unit 5 in a state supported by the support face 61*a*.

Further, the printing support section 62 includes a support face 62*a* that is parallel to a surface through which nozzles of the ink jet head 53 open, in a state where a prescribed gap is created from the surface through which the nozzles open.

The discharging support section 63 forms the transport path HK between the printing unit 5 and the winding section 42, and extends being curved to be convex forward while lowering height as approaching forward. The discharging support section 63 includes a support face 63*a* that supports the print medium M in a state of curving the print medium M. The support sections 61, 62, and 63 are arranged in a state that the respective support faces 61*a*, 62*a*, and 63*a* continuously connect to one another in a substantially planar manner.

As illustrated in FIG. 2, a preheater 71, a platen heater 72, and a support face afterheater 73*a* that are configured to heat the support face 60*a* are provided on a back side of the support member 60.

More specifically, the preheater 71 configured to heat the support face 61*a* is installed on a back side of the feeding support section 61. The preheater 71 is configured to preheat the print medium M over the support face 61*a*. Further, the platen heater 72 configured to heat the support face 62*a* facing the printing unit 5 is installed on a back side of the printing support section 62. Moreover, an afterheater 73 configured to heat the support face 63*a* is installed on a back side of the discharging support section 63. The support face afterheater 73*a* is configured to heat the print medium M over the support face 63*a* to dry an ink. The preheater 71, the platen heater 72, and the support face afterheater 73*a* thus heat the print medium M to rapidly dry and fix the ink onto the print medium M, to enhance the print quality, preventing bleeding, blur, and the like.

A print surface afterheater 73*b* that is attachable to and detachable from the body 3 is provided at a position facing the support face afterheater 73*a* with the discharging support section 63 interposed in between. The print surface afterheater 73*b* is configured to apply heat onto the print surface of the print medium M located over the discharging support section 63. This allows the ink to be rapidly dried and cured, thus further enhancing the print quality.

A tensioning mechanism 81 configured to apply tension to the print medium M is provided downward from a frond end portion of the discharging support section 63. The tensioning mechanism 81 includes a tension roller 82 that comes in contact with the print medium M between the discharging support section 63 and the winding section 42 to apply a pressing force against the print medium M. The tension roller 82 is rotatably supported on tip end portions of a pair of arm members 83, where the base end portions of the pair of arm members 83 are pivotally supported with respect to the pedestal 2. The tension roller 82 has an axial length that is longer in the width direction than a width of the print medium M. At a front lower zone of the discharging support section 63, the print medium M is wound on the roll body R2 in a state where a tension is applied to the print medium M in accordance with the weight of the tension roller 82.

As illustrated in FIG. 1, the printer 1 includes the ink cartridge holding unit 10 downward from an operation panel 9.

Figure 3:
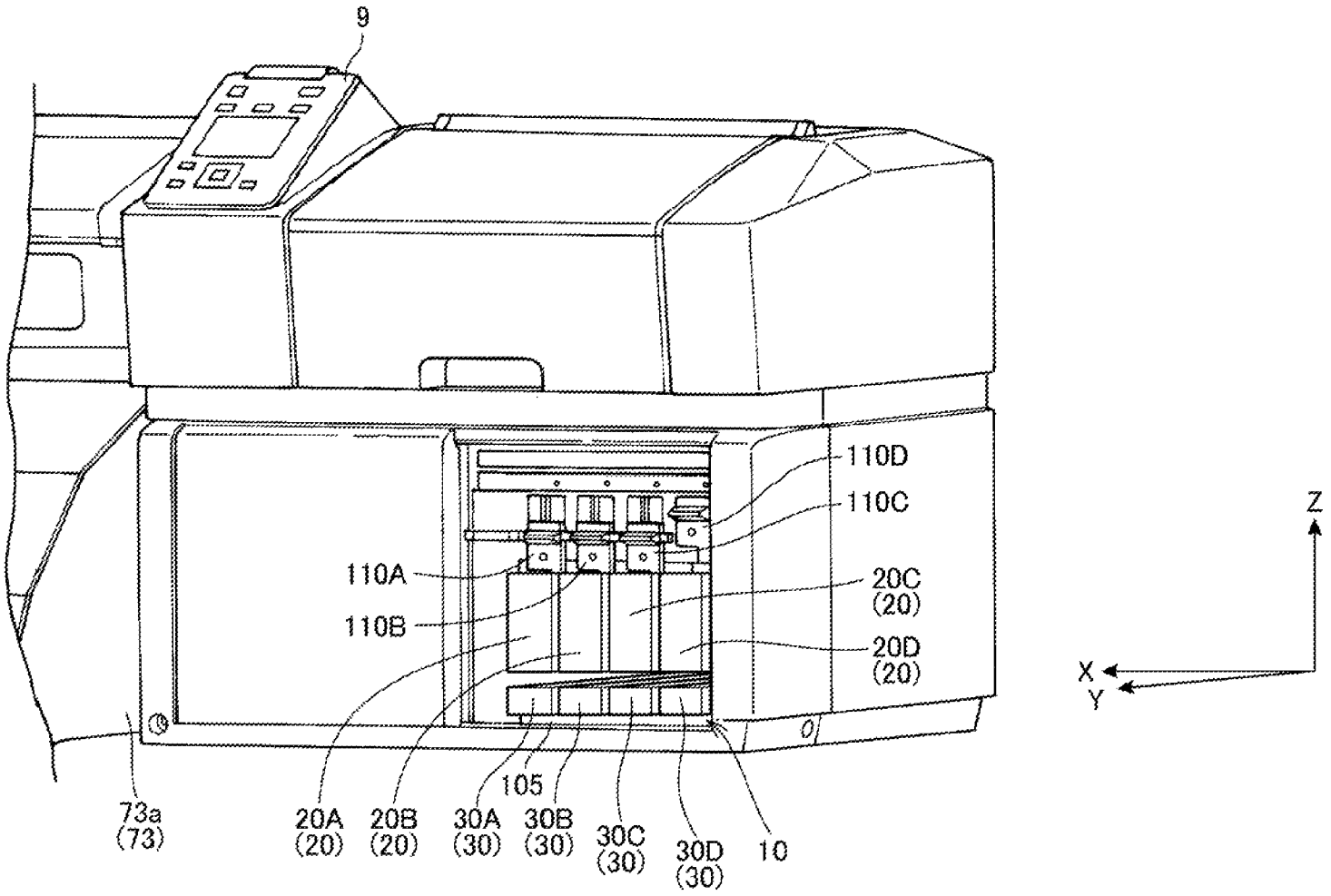
FIG. 3 is a view illustrating a configuration of a main portion of an ink cartridge holding unit.

FIG. 3 is a view illustrating a configuration of a main portion of the ink cartridge holding unit 10.

FIG. 3 illustrates a state where the ink cartridge holding unit 10 holds four ink cartridges 20 of ink cartridges 20A, 20B, 20C, and 20D.

The ink cartridges 20A, 20B, 20C, and 20D illustrated in FIG. 3 each store an ink of different color. For example, the ink cartridge 20A stores cyan ink, the ink cartridge 20B stores magenta ink, the ink cartridge 20C stores yellow ink, and the ink cartridge 20D stores black ink. The ink cartridges 20 are loaded to and held by the ink cartridge holding unit 10 to supply ink to the ink jet head 53 mounted on the carriage 52 through a non-illustrated ink tube.

Further, as illustrated in FIG. 3, the ink cartridge holding unit 10 is configured such that the ink cartridges 20 can be inserted into and removed from the ink cartridge holding unit 10. The ink cartridge holding unit 10 includes engagement portions 110A, 110B, 110C, and 110D for engaging the ink cartridges 20 that are inserted, to hold the ink cartridges 20 with the ink cartridge holding unit 10. Each of the engagement portions 110A, 110B, 110C, and 110D is correspondingly engaged with each of the ink cartridges 20A, 20B, 20C, and 20D.

Here, the ink cartridge 20 will be described below.

FIG. 4 is an external perspective view schematically illustrating a configuration of the ink cartridge 20.

The ink cartridge 20 includes an ink pack 210 configured to store an ink, an ink flow member 220 that causes an ink stored in the ink pack 210 to flow out, and a case 230 that houses the ink pack 210. The ink pack 210 corresponds to an example of an ink storage section.

The case 230, which is formed in a substantially rectangular parallelepiped shape with a top face 230A, a bottom face 230B, and three side faces 230C, houses the ink pack 210. As illustrated in FIG. 4, the side faces 230C are arranged standing from the bottom face 230B such that a side face 2311 and a side face 2313 are adjoined to a side face 2312 to face each other, and the side face 2311 and the side face 2313 face each other. Further, as illustrated in FIG. 4, the top face 230A is disposed to face the bottom face 230B and to be adjoined to the side faces 230C. This allows the case 230 to form a substantially rectangular parallelepiped shape that has an interior space.

The ink pack 210, which has a bag-like form that ink impermeable films are jointed to each other, stores an ink thereinside. The ink pack 210 is fixed inside the case 230 by a prescribed method. An opening portion 213 that is coupled with the ink flow member 220 is formed in the ink pack 210.

The ink flow member 220, which is a block body formed of, for example, a resin, is coupled to the ink pack 210 to seal the opening portion 213 formed in the ink pack 210. The ink flow member 220 is fixed to an opening portion 231 of the case 230 with the ink pack 210 being housed in the case 230. An ink flow outlet 221 that causes an ink to flow out is formed in the ink flow member 220. The ink cartridge 20 is inserted into and removed from the ink cartridge holding unit 10 such that the ink flow member 220 faces a back face of the ink cartridge holding unit 10. When the ink cartridge 20 is held by the ink cartridge holding unit 10, the ink flow outlet 221 of the ink pack 210 is inserted with a supply needle for supplying an ink to the printer 1. The ink stored in the ink pack 210 is then supplied to the printer 1 through the supply needle that is inserted into the ink flow outlet 221.

An IC chip 300 is provided at the bottom face 230B of the case 230. The IC chip 300 corresponds to an example of an information storage medium. The IC chip 300 is mounted with components such as a communication circuit configured to perform wireless communication in accordance with a prescribed communication standard, a memory device configured to store information in a non-volatile manner, and a control circuit configured to control the components of the IC chip 300. The IC chip 300 is configured to store ink information IJ about the ink stored in the ink pack 210 that is provided. The ink information IJ includes, for example, information such as ink consumption amount information indicating consumption amount of ink consumed by printing, ink remaining amount information indicating remaining amount of ink in the ink pack 210, and ink color information indicating a color of ink stored in the ink pack 210.

Returning to the description of FIG. 3, the ink cartridge holding unit 10 includes a blocking member 30 downward from the ink cartridge 20, and includes an access unit 105 downward from the blocking member 30. The access unit 105 corresponds to an example of a wireless communication unit.

Each of blocking members 30A, 30B, 30C, and 30D is provided at a position corresponding to each of the ink cartridges 20A, 20B, 20C, and 20D. Each of the blocking members 30A, 30B, 30C, and 30D moves in the front-back direction in response to a driving of a blocking member drive motor 106A, which will be described later, to switch the state to one of a blocking state or a blocking stop state. Each of the blocking members 30A, 30B, 30C, and 30D is formed of, for example, a material of magnetic body, and blocks, when the state is the blocking state, wireless communication between the IC chip 300 of the ink cartridge 20 corresponding to each of the blocking members 30A, 30B, 30C, and 30D, and the access unit 105.

Figure 5:
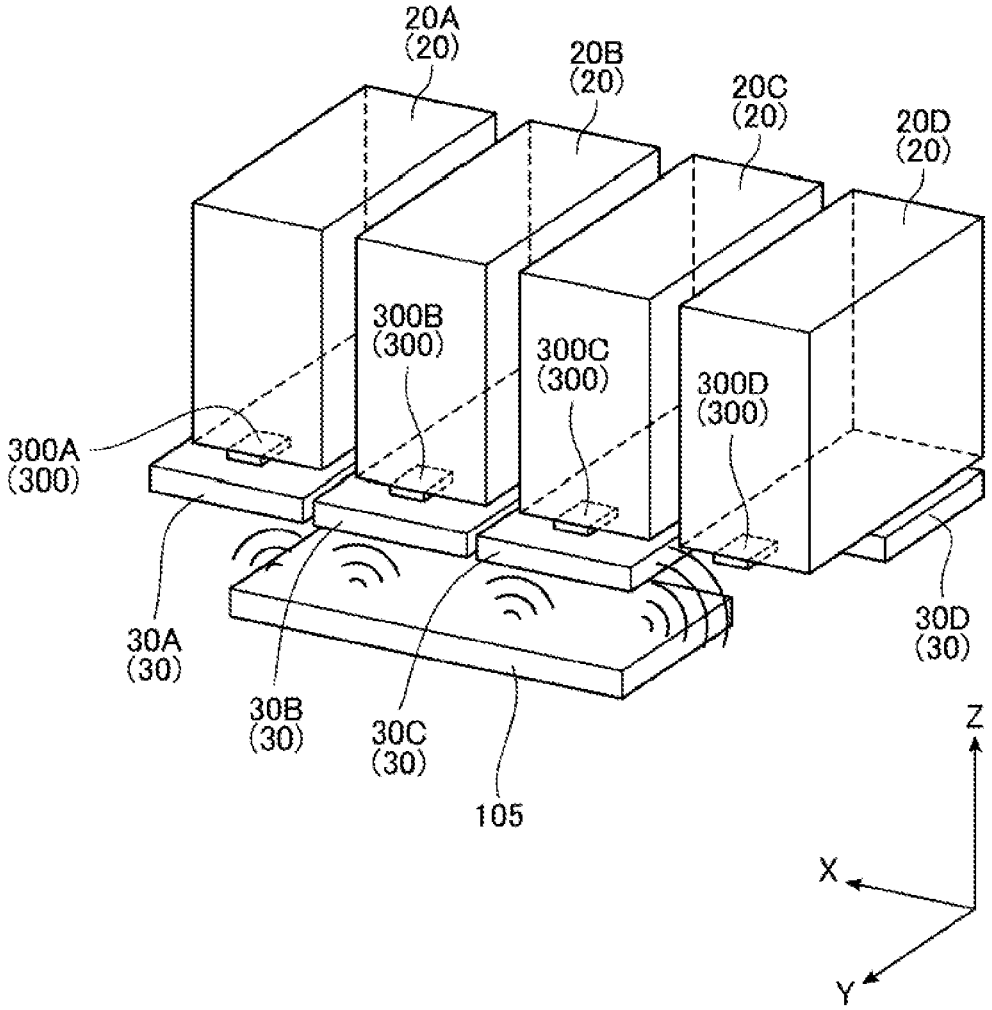
FIG. 5 is an explanatory view illustrating a blocking member.

FIG. 5 is an explanatory view illustrating the blocking member 30.

FIG. 5 schematically illustrates the interior of the ink cartridge holding unit 10 that holds the ink cartridges 20A, 20B, 20C, and 20D.

Further, FIG. 5 illustrates a case where the blocking members 30A, 30B, and 30C of the four blocking members 30 are in the blocking state, and the blocking member 30D is in the blocking stop state.

The blocking state represents a state where the wireless communication between the IC chip 300 of the ink cartridge 20 and the access unit 105 is blocked. FIG. 5 exemplifies a state where the blocking member 30 is located directly downward from the IC chip 300, as the blocking state.

The blocking stop state represents a state where the wireless communication between the IC chip 300 of the ink cartridge 20 and the access unit 105 is not blocked. In other words, the blocking stop state represents a state of the blocking member 30 where the IC chip 300 of the ink cartridge 20 can perform wireless communication with the access unit 105. FIG. 5 exemplifies a state where the blocking member 30 is not located directly downward from the IC chip 300 of the ink cartridge 20, as the blocking stop state.

In FIG. 5, the blocking members 30A, 30B, and 30C are in the blocking state. Accordingly, each of IC chips 300A, 300B, and 300C cannot perform wireless communication with the access unit 105. On the other hand, in FIG. 5, the blocking member 30D is in the blocking stop state. Accordingly, an IC chip 300D can perform wireless communication with the access unit 105.

As illustrated in FIG. 5, the IC chip 300 of the first embodiment is configured to perform wireless communication in a non-contact manner with the printer 1 via the access unit 105. This provides an advantage described below. In a configuration in which the IC chip 300 and the printer 1 communicates with each other while being in contact with each other, a contact failure may occur due to a certain factor. When the contact failure occurs, the printer 1 interrupts printing, and thus time required for the printing is prolonged. In addition, when the contact failure occurs, the ink remaining amount information may not be properly written, and the IC chip 300 may store, as information, remaining amount of ink that is different from the actual remaining amount of ink in the ink pack 210. However, the IC chip 300 of the first embodiment, which performs wireless communication in a non-contact manner with the printer 1, can avoid the prolonged printing time due to a contact failure, and can prevent the remaining amount of ink that the IC chip 300 stores as information from becoming estranged from the actual remaining amount of ink in the ink pack 210.

Note that a configuration such as shape, thickness, or the like of the blocking member 30 is properly determined and employed with a previously conducted test, simulation, or the like, such that wireless communication between the IC chip 300 corresponding to the blocking member 30 and the access unit 105 may be blocked in case being the blocking state. Further, the position of the blocking member 30 in the front-back direction in the blocking state has been properly determined by a previously conducted test, simulation, or the like, such that wireless communication between the IC chip 300 corresponding to the blocking member 30 and the access unit 105 may be blocked. In addition, the position of the blocking member 30 being in the blocking stop state in the front-back direction has been properly determined by a previously conducted test, simulation, or the like, such that wireless communication between the IC chip 300 corresponding to the blocking member 30 and the access unit 105 may not be blocked.

First, a functional configuration of the printer 1 will be described below.

Figure 6:
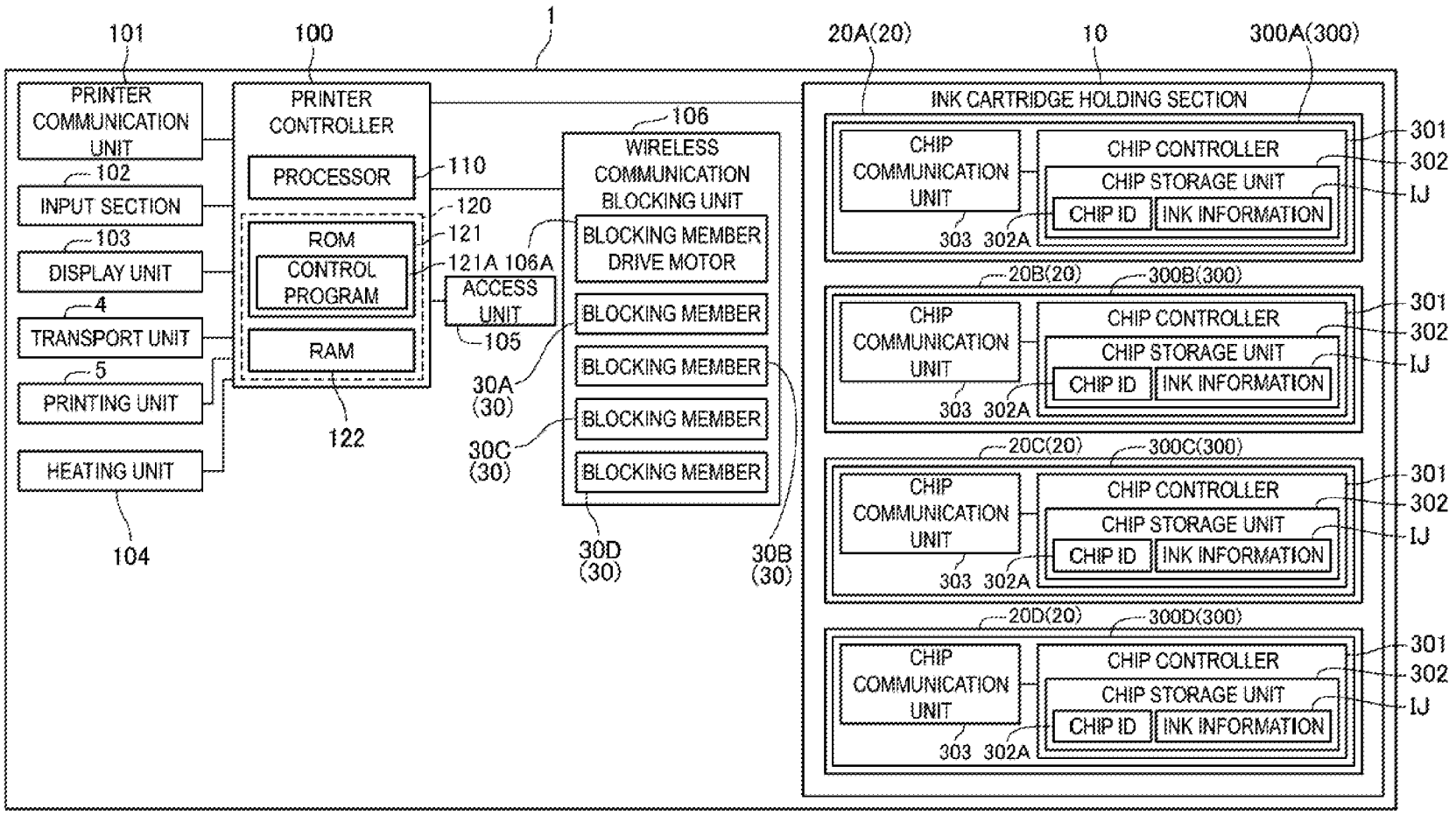
FIG. 6 is a block diagram schematically illustrating a functional configuration of a printer.

FIG. 6 is a block diagram schematically illustrating the functional configuration of the printer 1.

As illustrated in FIG. 6, the printer 1 includes a printer controller 100, a printer communication unit 101, an input section 102, a display unit 103, a transport unit 4, a printing unit 5, a heating unit 104, the access unit 105, a wireless communication blocking unit 106, and the ink cartridge holding unit 10. The printer controller 100 corresponds to an example of a controller.

The printer controller 100 includes a processor 110 configured to execute arithmetic processing such as that of a CPU, a ROM 121, or a RAM 122 to control the components of the printer 1. The controller 100 is configured to execute, by cooperation of hardware and software, processing, for example, that the processor 110 reads out a control program 121A stored in the ROM 121 to the RAM 122.

The processor 110 is configured to read out and execute the control program 121A stored in the ROM 121 to control the components of the printer 1.

The ROM 121 is configured to store data in a non-volatile manner. The ROM 121 stores various data in a non-volatile manner in addition to the control program 121A to be executed by the processor 110.

The RAM 122 is configured to temporarily store various data. The RAM 122 functions as a work area of the processor 110.

The printer controller 100 is constituted by the processor 110 and a printer storage unit 120. The printer storage unit 120 is a storage device configured to store, in a non-volatile manner, the control program 121A to be executed by the processor 110 and various data. The printer storage unit 120 is constituted by a semiconductor storage element such as a flash ROM, or the like. The printer storage unit 120 may include the RAM 122 constituting a work area of the processor 110.

The printer communication unit 101 includes a communication hardware that accords with a prescribed communication standard. The printer communication unit 101 is configured, controlled by the printer controller 100, to communicate with an external apparatus in accordance with the prescribed communication standard. Examples of the external apparatus configured to communicate with the printer communication unit 101 include a host computer configured to send image data, and print data having undergone various processings on the image data, to the printer 1.

The input section 102 includes input means such as an operation switch and a touch panel provided in the printer 1. The input section 102 is configured to detect an operation of a user on the input means and to output the operation to the printer controller 100. The printer controller 100 is configured to execute processing corresponding to an operation on the input means, based on an input from the input section 102.

The display unit 103 includes a plurality of LEDs, a display panel, and the like. The display unit 103 is configured, controlled by the printer controller 100, to perform, in a prescribed manner, turning on/off of the LEDs, displaying of information on the display panel, and the like.

The transport unit 4 has configurations related to the transport of the print medium M, such as the feeding section 41, the winding section 42, and the transport roller pair 43, which are described above. The transport unit 4 is configured, controlled by the printer controller 100, to transport the print medium M in the transport direction HY.

The printing unit 5 includes configurations related to the printing onto the print medium M, such as the carriage 52, the ink jet head 53 mounted on the carriage 52, a drive circuit configured to drive the ink jet head 53, and a carriage drive motor configured to cause the carriage 52 to scan in the cross direction KY crossing the transport direction HY. The printing unit 5 is configured, controlled by the printer controller 100, to cause an image to be printed onto the print surface of the print medium M.

The heating unit 104 includes the preheater 71, the platen heater 72, and the afterheater 73, which are described above. The heating unit 104 is configured, controlled by the printer controller 100, to heat the print medium M being transported.

The access unit 105 includes a communication hardware that accords with a prescribed short-range wireless communication standard. The access unit 105 is configured, controlled by the printer controller 100, to perform wireless communication with the IC chip 300 of the ink cartridge 20 held by the ink cartridge holding unit in accordance with the prescribed short-range wireless communication standard. The access unit 105, which is provided at a position at which the access unit 105 does not come in contact with the IC chip 300 of the ink cartridges 20 held by the ink cartridge holding unit 10, performs wireless communication in a non-contact manner with the IC chip 300.

The wireless communication blocking unit 106 has a configuration for blocking wireless communication between the access unit 105 and the IC chip 300, such as the blocking member drive motor 106A and the blocking members 30A, 30B, 30C, and 30D. The wireless communication blocking unit 106 drives the blocking member drive motor 106A, in accordance with the control of the printer controller 100, to cause each of the blocking members 30A, 30B, 30C, and 30D to be in the blocking state or the blocking stop state.

The ink cartridge holding unit 10 is configured to hold the plurality of ink cartridges 20 each including the IC chip 300.

The IC chip 300 includes a chip controller 301 and a chip communication unit 303.

The chip controller 301 includes a control circuit mounted on the IC chip 300, and a chip storage unit 302. The chip controller 301 is configured to execute, by cooperation of hardware and software, processing to control the components of the IC chip 300.

The chip storage unit 302 is constituted by a non-volatile memory device. The chip storage unit 302 is configured to store various data in a rewritable manner. The chip storage unit 302 stores a chip ID 302A in addition to the ink information IJ. The chip ID 302A corresponds to an example of identification information. The chip ID 302A is information that identifies the IC chip 300. The chip ID 302A is a unique value for the ink cartridge 20.

The chip communication unit 303 includes hardware in accordance with a prescribed short-range wireless communication standard. The chip communication unit 303 is configured, controlled by the chip controller 301, to perform wireless communication with the access unit 105 of the printer 1 in accordance with the prescribed short-range wireless communication standard.

Next, an operation of the printer 1 will be described below.

Figure 7:
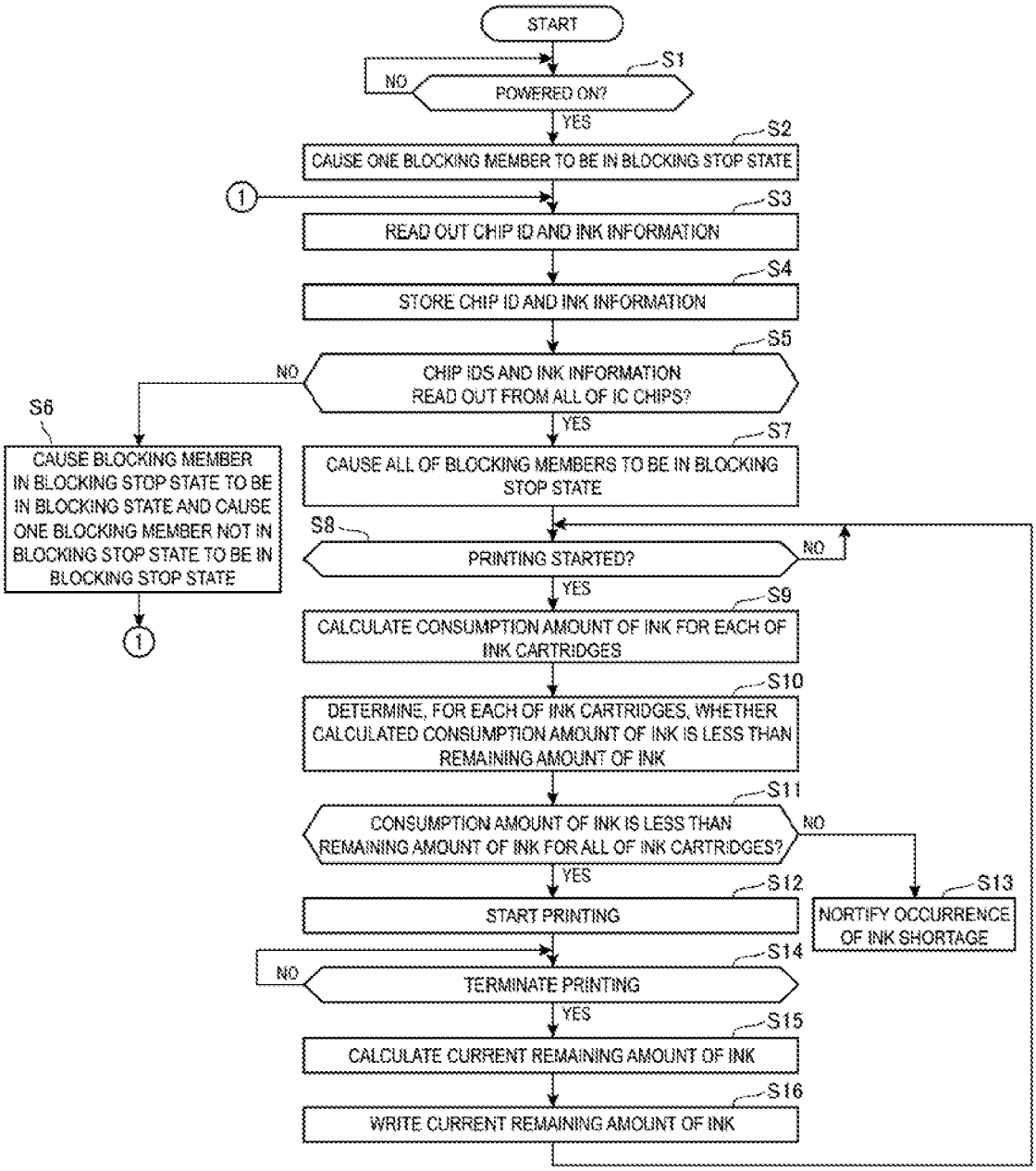
FIG. 7 is a flowchart illustrating an operation of a printer.

FIG. 7 is a flowchart illustrating the operation of the printer 1. In the flowchart illustrated in FIG. 7, it is assumed that the ink cartridge holding unit 10 holds the ink cartridges 20A, 20B, 20C, and 20D. It is also assumed that the blocking members 30A, 30B, 30C, and 30D are in the blocking state at the start timing of the flowchart illustrated in FIG. 7.

The printer controller 100 of the printer 1 determines whether the printer 1 is powered on (step S1).

The printer controller 100, when determined that the printer 1 has been powered on (step S1: YES), controls the wireless communication blocking unit 106 to cause the state of the blocking member 30 of any one of the blocking members 30A, 30B, 30C, and 30D to be in the blocking stop state (step S2).

For example, the printer controller 100, when causing the blocking member 30 to be in the blocking stop state in the order of the blocking members 30A, 30B, 30C, and 30D, controls, in the first processing of the step S2, the wireless communication blocking unit 106 to cause only the blocking member 30A to be in the blocking stop state.

The printer controller 100, when caused any one of the blocking members 30A, 30B, 30C, and 30D to be in the blocking stop state, controls the access unit 105 to perform wireless communication with the IC chip 300, to read out the chip ID 302A and the ink information IJ stored in the chip storage unit 302 (step S3).

In step S3, three blocking members 30 out of the four blocking members 30 are in the blocking state, and the remaining one blocking member 30 is in the blocking stop state. Accordingly, in step S3, the printer controller 100 reads out the chip ID 302A and the ink information IJ from one certain IC chip 300 out of the IC chips 300A, 300B, 300C, and 300D.

Next, the printer controller 100 causes the printer storage unit 120 to store the chip ID 302A and the ink information IJ that are read out from the IC chip 300 (step S4). In step S4, the printer controller 100 associates the chip ID 302A and the ink information IJ that are read out with each other, and causes the printer storage unit 120 to store the chip ID 302A and the ink information IJ.

Next, the printer controller 100 determines whether the chip ID 302A and the ink information IJ have been read out from the IC chip 300 of each of the plurality of ink cartridges 20 held by the ink cartridge holding unit 10 (step S5). That is, the printer controller 100 determines whether the chip ID 302A and the ink information IJ have been read out from all of the IC chips 300A, 300B, 300C, and 300D.

The printer controller 100, when determined as negative in step S5, controls the wireless communication blocking unit 106 to cause the blocking member 30 in the blocking stop state to be in the blocking state, and to cause one of the blocking members 30 that are not in the blocking stop state to be in the blocking stop state (step S6).

For example, the printer controller 100, when having caused only the blocking member 30A to be in the blocking state in case when the blocking member 30 is caused to be in the blocking stop state in the order of the blocking members 30A, 30B, 30C, and 30D, causes the blocking member 30A to return to be in the blocking state and causes only the blocking member 30B to be in the blocking stop state, in the first processing of the step S6.

The printer controller 100, when having executed the processing of step S6, causes the processing to return to step S3, and controls the access unit 105 to read out the chip ID 302A and the ink information IJ from the IC chip 300.

Returning to the description of step S5, the printer controller 100, when determined that the chip ID 302A and the ink information IJ have been read out from the IC chip 300 of each of the plurality of ink cartridges 20 held by the ink cartridge holding unit 10 (step S5: YES), executes the processing of step S7.

As such, the printer controller 100, when reading out the chip ID 302A and the ink information IJ from the IC chip 300 of each of the plurality of ink cartridges 20, performs wireless communication with the IC chip 300 one by one with the access unit 105. This allows the printer controller 100 to avoid acquiring the chip IDs 302A and the ink information IJ simultaneously from the plurality of IC chips 300, and allows the printer storage unit 120 to properly administrate the chip ID 302A and the ink information IJ without being led to a wrong corresponding relationship, for example.

Specifically, the printer controller 100, when reading out the chip ID 302A and the ink information IJ from the IC chip 300 of each of the plurality of ink cartridges 20, causes the wireless communication blocking unit 106 to block wireless communication between the IC chip 300 from which reading out is not performed and the access unit 105. This allows the printer controller 100 to cause the access unit 105 and the IC chip 300 to perform wireless communication with each other in a one-to-one manner, and the printer controller 100 can be reliably prevented from acquiring the chip IDs 302A and the ink information IJ simultaneously from the plurality of IC chips 300 due to collision or the like.

Returning to the description of the flowchart in FIG. 7, the printer controller 100, when determined as positive in step S5, controls the wireless communication blocking unit 106 to cause all of the blocking members 30 to be in the blocking stop state (step S7).

Next, the printer controller 100 determines whether to start printing (step S8). For example, the printer controller 100, when received the print data from an external apparatus such as a host computer via the printer communication unit 101, determines as positive in step S8.

Note that the print data received from the external apparatus via the printer communication unit 101 are data having undergone resolution conversion processing, color conversion processing, halftone processing, rasterization processing, command addition processing, and the like, on the image data indicating an image to be printed onto the print medium M. Note that the printer controller 100 may receive the above-described image data from the external apparatus, and perform these processings on the image data to generate print data. In this case, the printer controller 100 determines as positive in step S8, triggered by the reception of the image data.

The printer controller 100, when determined to start printing (step S8: YES), calculates, based on print data referenced when performing printing, consumption amount of ink for each of the ink cartridges 20 held by the ink cartridge holding unit 10 (step S9).

Next, the printer controller 100 determines, for each of the ink cartridges 20 held by the ink cartridge holding unit 10, whether the consumption amount of ink as calculated is less than the remaining amount of ink in the ink cartridge 20 (step S10). In step S10, the printer controller 100 references the ink information IJ stored in the printer storage unit 120 to compare the consumption amount of ink as calculated with the remaining amount of ink indicated by the ink remaining amount information included in the ink information IJ.

Next, the printer controller 100 determines whether the consumption amount of ink for all of the ink cartridges 20 held by the ink cartridge holding unit 10 is less than the remaining amount of ink in step S10 (step S11).

The printer controller 100, when determined that the consumption amount of ink for all of the ink cartridges 20 held by the ink cartridge holding unit 10 is less than the remaining amount of ink (step S11: YES), controls the transport unit 4, the printing unit 5, and the heating unit 104 to start printing (step S12).

On the other hand, the printer controller 100, when determined that the consumption amount of ink for at least one of the plurality of ink cartridges 20 held by the ink cartridge holding unit 10 is not less than the remaining amount of ink (step S10: NO), notifies an occurrence of an ink shortage (step S13). The notification aspect may be displaying of information by the display unit 103, or may be sending of information by the printer communication unit 101.

Next, the printer controller 100, when starts printing, determines whether the printing has been terminated (step S14).

The printer controller 100, when determined the printing has been terminated (step S14: YES), calculates current remaining amount of ink in the ink cartridge 20 for each of the ink cartridges 20 held by the ink cartridge holding unit 10 (step S15).

Next, the printer controller 100, for each of the ink cartridges 20, writes the ink remaining amount information indicating the remaining amount of ink as calculated in the IC chip 300 (step S16).

In step S16, the printer controller 100 writes the ink remaining amount information in the IC chip 300 for each of the ink cartridges 20, using the chip ID 302A of the IC chip 300.

For example, the printer controller 100, when writing the ink remaining amount information in the IC chip 300A, causes the access unit 105 to send a combination of the chip ID 302A of the IC chip 300A and the ink remaining amount information to the IC chips 300A, 300B, 300C, and 300D. The chip controller 301 of each of the IC chips 300 receives the combination to compare the chip ID 302A included in the combination with the chip ID 302A stored in the chip storage unit 302. The chip controller 301 of each of the IC chips 300, when the chip IDs 302A as compared coincide with each other, updates the ink remaining amount information included in the combination to the ink remaining amount information included in the ink information IJ stored by the chip storage unit 302. On the other hand, the chip controller 301 of each of the IC chips 300, when the chip IDs 302A as compared do not coincide with each other, discards the combination as received. Accordingly, the IC chip 300A updates the remaining amount of ink, while the chips 300B, 300C, and 300D do not update the remaining amount of ink.

As such, the printer controller 100 writes, based on the chip ID 302A, the ink remaining amount information in each of the IC chips 300 of the plurality of ink cartridges 20. The printer controller 100, which writes the remaining amount of ink based on the chip ID 302A, can write proper remaining amount of ink in each of the plurality of IC chips 300 without writing wrong ink remaining amount information in an IC chip 300.

Returning to the description of the flowchart in FIG. 7, the printer controller 100, upon writing the remaining amount of ink, causes the processing to return to step S8.

In the above-described operation of the printer 1, reading out of the chip ID 302A and the ink information IJ from each of the IC chips 300 is triggered by the power on of the printer 1. However, it suffices that the timing of the reading out of the chip ID 302A and the ink information IJ be before starting of the printing. Thus, for example, the printer controller 100 may execute the processes of step S2 through step S7 after determined as positive in step S8.

Further, in the above-described operation of the printer 1, all of the blocking members 30 are caused to be in the blocking stop state before starting of the printing. It suffices that the timing of causing all of the blocking members 30 to be in the blocking stop state be before performing of the processing in step S15 without being limited to before starting of the printing.

Further, in the above-described operation of the printer 1, an example is given in which the remaining amount of ink is written in the IC chip 300 after printing is performed. The processing related to the ink information IJ executed based on the chip ID 302A is not limited to the writing of the remaining amount of ink. For example, the printer 1 may write the consumption amount of ink, or may read out the ink information IJ, as a processing related to the ink information IJ executed based on the chip ID 302A.

As described above, the printer 1 includes the ink cartridge holding unit 10 configured to hold the plurality of ink cartridges 20 each including the ink pack 210 configured to store an ink and the IC chip 300 configured to store ink information IJ about the ink stored in the ink pack 210, the access unit 105 configured to perform wireless communication in a non-contact manner with the IC chip 300 of the ink cartridges 20 held by the ink cartridge holding unit 10, and the printer controller 100. The IC chip 300 is configured to store the chip ID 302A. The printer controller 100 is configured to acquire, via the access unit 105, the chip ID 302A from the IC chip 300 of each of the plurality of ink cartridges 20 held by the ink cartridge holding unit 10, and configured to execute, based on the chip ID 302A as acquired, processing related to the ink information IJ with the IC chip 300 of each of the plurality of ink cartridges 20 via the access unit 105.

According to the above configuration, the printer controller 100, in order to execute the processing related to the ink information IJ based on the chip ID 302A, can select each of the plurality of IC chips 300 to execute the processing related to the ink information IJ. Accordingly, the printer controller 100 can properly execute the processing related to the ink information IJ for each of the plurality of IC chips 300 without writing wrong ink remaining amount information in an IC chip 300, for example.

The printer controller 100 is configured to perform, when acquiring the chip ID 302A from the IC chip 300 of each of the plurality of ink cartridges 20, wireless communication with the IC chip 300 one by one via the access unit 105.

According to the above configuration, the printer controller 100 can avoid acquiring the chip IDs 302A simultaneously from the plurality of IC chips 300. Accordingly, the printer controller 100 can be prevented from acquiring the chip IDs 302A in a duplicated manner, and can prevent the chip ID 302A and information from being led to a wrong corresponding relationship when associating information with the chip ID 302A, to thus properly administrate the plurality of IC chips 300.

The printer 1 includes the wireless communication blocking unit 106 that can block wireless communication between the access unit 105 and the IC chip 300. The printer controller 100 is configured to cause, when acquiring the chip ID 302A from the IC chip 300, the wireless communication blocking unit 106 to block wireless communication between the IC chip 300 other than an IC chip 300 from which the chip ID 302A is to be acquired and the access unit 105.

According to the above configuration, the printer controller 100 can cause the access unit 105 and the IC chip 300 to perform wireless communication with each other in a one-to-one manner, and can be reliably prevented from acquiring the chip IDs 302A simultaneously from the plurality of IC chips 300 due to collision or the like. Accordingly, the printer controller 100 can be reliably prevented from acquiring the chip IDs 302A in a duplicated manner, and can reliably prevent the chip ID 302A and information from being led to a wrong corresponding relationship when associating information with the chip ID 302A, to thus properly administrate the plurality of IC chips 300.

Second Embodiment

Figure 8:
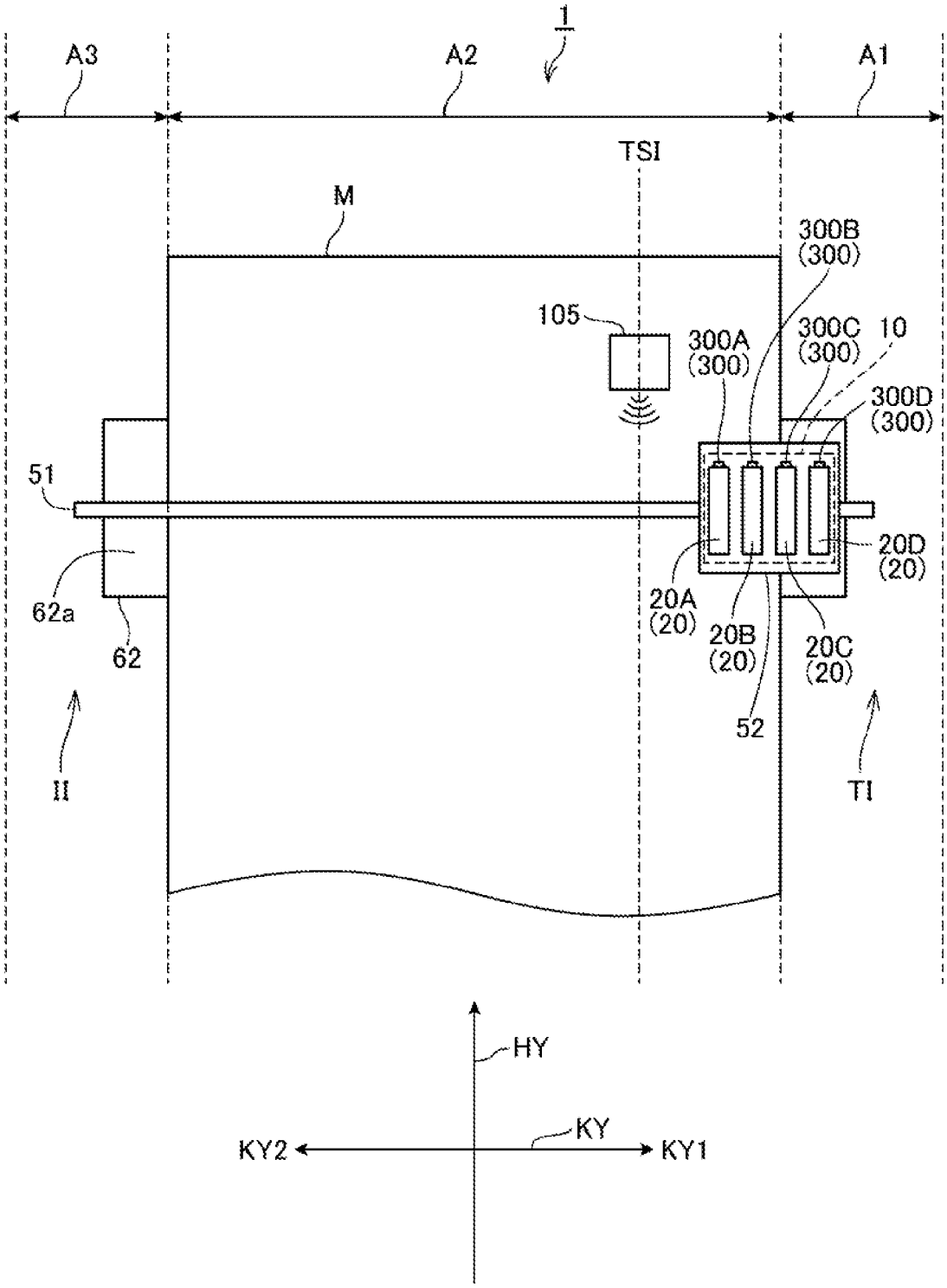
FIG. 8 is a cross-sectional view illustrating a configuration of a printer according to a second embodiment.

FIG. 8 is a cross-sectional view illustrating a configuration of a printer 1 according to a second embodiment.

The printer 1 according to the second embodiment is the printer 1 of on-carriage type in which a plurality of ink cartridges 20 can be mounted on a carriage 52.

As illustrated in FIG. 8, the printer 1 is provided with a guide shaft 51 extending in a cross direction KY crossing the transport direction HY in which a print medium M is transported at a position facing a printing support section 62. The carriage 52 is provided on the guide shaft 51 to be reciprocally movable along the guide shaft 51 via a non-illustrated drive mechanism. That is, the carriage 52 is reciprocally movable in the cross direction KY along the guide shaft 51.

The carriage 52, when the printer 1 does not perform printing, is located at a standby position TI at which the carriage 52 is caused to stand by. The standby position TI is included in a non-print region A1. The non-print region A1 is a region in which the ink jet head 53 does not discharge an ink in the cross direction KY, and is a region located on the direction KY1 side of the cross direction KY from a print region A2 and a non-print region A3. The side of the non-print region A1 in the cross direction KY is referred to as full side or FULL side. Note that the print region A2 is a region that is interposed between the non-print regions A1 and A3 in the cross direction KY, in which the ink jet head 53 can discharge an ink. The non-print region A3 will be described later. The non-print region A1 is provided with a mechanism configured to load a cap for preventing an occurrence of discharge failure to the ink jet head 53 when the carriage 52 is located at the standby position TI. The non-print region A1 may further be provided with a mechanism configured to perform maintenance such as cleaning or flushing on the ink jet head 53. Note that the carriage 52 being located at the standby position TI represents that at least, a nozzle row located farthest in the direction KY2 among the nozzle rows included in the ink jet head 53 is located in the non-print region A1.

The carriage 52, when the printer 1 starts printing, moves from the standby position TI to a print start position II. The print start position II is a position at which the carriage 52 is located when printing is started. The print start position II is included in the non-print region A3. The non-print region A3 is a region in which the ink jet head 53 does not discharge an ink in the cross direction KY, and is a region located on the direction KY2 side of the cross direction KY from the print region A2 and the non-print region A1. The side of the non-print region A3 in the cross direction KY is referred to as home side or HOME side. The carriage 52 being located at the print start position II represents that at least, a nozzle row located farthest in the direction KY1 among the nozzle rows included in the ink jet head 53 is located in the non-print region A1.

The carriage 52 is mounted with the ink jet head 53. The carriage 52 is also provided with the ink cartridge holding unit 10. The ink cartridge holding unit 10 holds the ink cartridges 20A, 20B, 20C, and 20D aligned in the cross direction KY. In FIG. 8, the carriage 52 is mounted with the ink cartridge 20 such that the IC chip 300 is located, at the carriage 52, downstream of the transport direction HY.

The printer 1 is provided with the access unit 105 downstream of the transport direction HY from the carriage 52. The access unit 105 perform wireless communication in a non-contact manner with the IC chip 300 of the ink cartridge 20 located at a communication position TSI at which wireless communication is possible with the access unit 105. The access unit 105 is provided at a suitable position, to enable performing wireless communication with only the ink cartridge 20 located at the communication position TSI. This position is determined in advance by a previously conducted test, simulation, or the like. Note that the access unit 105 may be provided upstream of the transport direction HY from the carriage. In case of the above configuration, the ink cartridge holding unit 10 of the carriage 52 holds the ink cartridge 20 such that the IC chip 300 is located, at the carriage 52, upstream of the transport direction HY.

Next, an operation of the printer 1 of the second embodiment will be described below.

Figure 9:
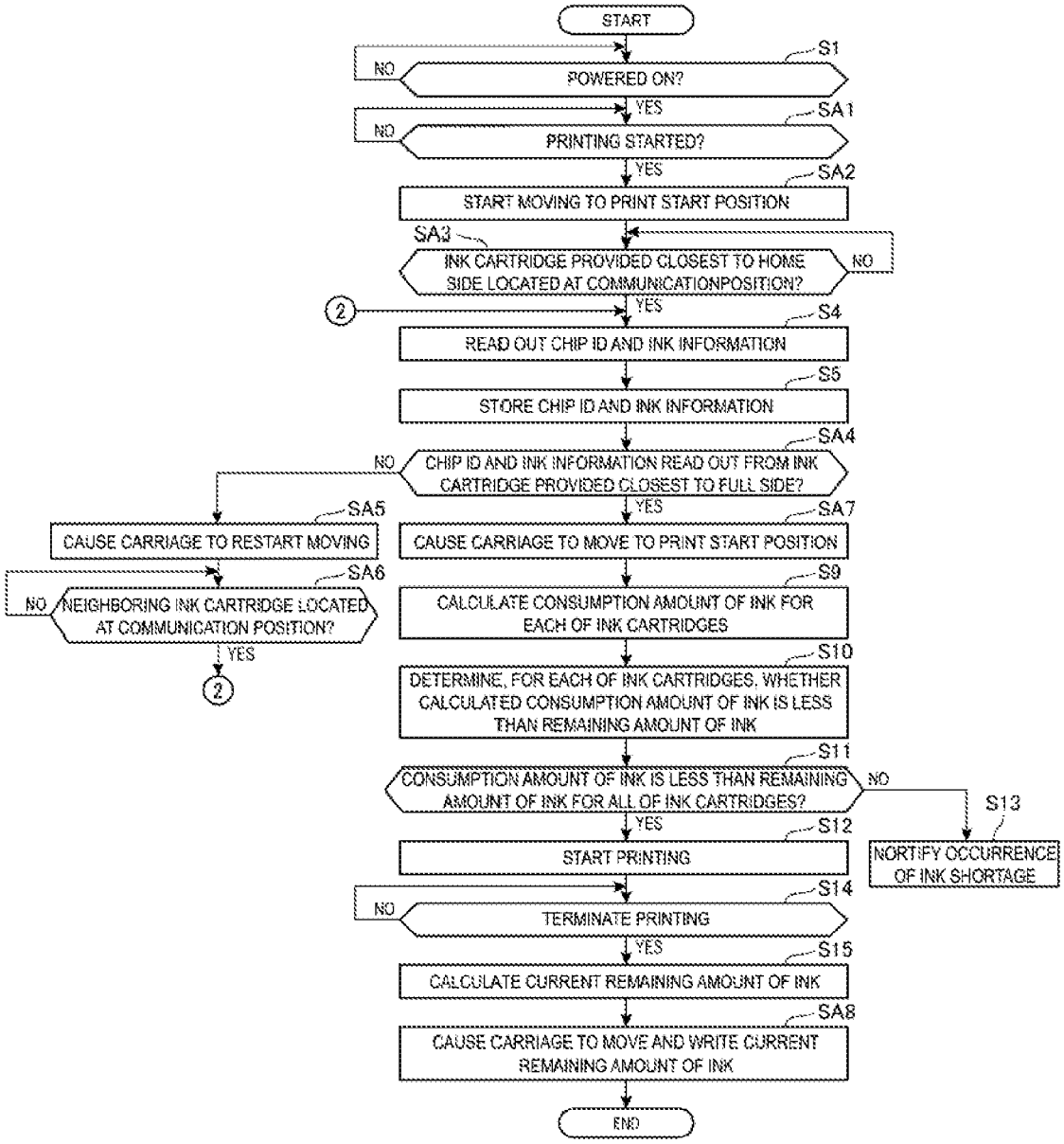
FIG. 9 is a flowchart illustrating an operation of a printer.

FIG. 9 is a flowchart illustrating the operation of the printer 1 according to the second embodiment. In the flowchart illustrated in FIG. 9, a processing being identical to the processing in FIG. 7 is denoted by an identical step number and description of the identical processing will not be given.

In the description of the flowchart in FIG. 9, it is assumed that the ink cartridge holding unit 10 holds the ink cartridges 20A, 20B, 20C, and 20D. It is also assumed that the carriage 52 is located at the standby position TI at the start timing of the flowchart in FIG. 9.

The printer controller 100 of the printer 1, when determined that the printer 1 has been powered on (step S1: YES), determines whether to start printing (step SA1).

The printer controller 100, when determined to start printing (step SA1: YES), causes the carriage 52 to start moving from the standby position TI to the print start position II (step SA2).

The printer controller 100 determines whether the ink cartridge 20A is located at the communication position TSI at which wireless communication is possible with the access unit 105 (step SA3). That is, the printer controller 100 determines whether the ink cartridge 20 provided closest to the home side is located at the communication position TSI at which wireless communication is possible with the access unit 105. Note that the communication position TSI in the cross direction KY and the position of the ink cartridge 20A at the carriage 52 are determined in advance, and the printer controller 100 can easily execute the determination in step SA3.

The printer controller 100, when determined that the ink cartridge 20 provided closest to the home side is located at the communication position TSI (step SA3: YES), causes the carriage 52 to stop moving, and causes the access unit 105 to read out the chip ID 302A and the ink information IJ from the IC chip 300 (step S4).

Next, the printer controller 100 causes the printer storage unit 120 to store the chip ID 302A and the ink information IJ as read out (step S5).

Next, the printer controller 100 determines whether the chip ID 302A and the ink information IJ have been read out from the IC chip 300D of the ink cartridge 20D (step SA4). That is, the printer controller 100 determines whether the chip ID 302A and the ink information IJ have been read out from the IC chip 300 of the ink cartridge 20 located closest to the full side.

The printer controller 100, when determined as negative in step SA4, causes the carriage 52 to restart moving to the print start position II (step SA5). Next, the printer controller 100 determines whether the ink cartridge 20 located neighboring the IC chip 300 from which the reading out has been performed in step S4 is located at the communication position TSI (step SA6). Note that the communication position TSI in the cross direction KY and a distance between the respective ink cartridges 20 are determined in advance, and the printer controller 100 can easily execute the determination in step SA6.

The printer controller 100, when determined as positive in step SA6, causes the processing to return to step S4, to read out the chip ID 302A and the ink information IJ.

With reference to step SA4, the printer controller 100, when determined as positive in step SA4, causes the carriage 52 to move to the print start position II (step SA7). Then, the printer controller 100 executes processings subsequent to step S9.

The printer controller 100, when terminated the printing and calculated the current remaining amount of ink in the ink cartridge 20, causes the carriage 52 to move and writes the ink remaining amount information indicating the remaining amount of ink as calculated in the IC chip 300 for each of the ink cartridges 20 (step SA8).

In step SA8, the printer controller 100, in case when the carriage 52 is located at the print start position II when printing is terminated, causes the carriage 52 to move to the standby position TI. The printer controller 100, during the above movement, writes the ink remaining amount information, for each of the ink cartridges 20, by causing the access unit 105 to wirelessly communicate with the IC chip 300 of the ink cartridge 20 located at the communication position TSI. The writing herein is performed based on the chip ID 302A, as in step S16 of the flowchart illustrated in FIG. 7. This allows even the printer 1 of on-carriage type to provide an advantage as in the first embodiment As described above, the printer 1 of the second embodiment includes the carriage 52 provided with the ink cartridge holding unit 10. The ink cartridge holding unit 10 holds the plurality of ink cartridges 20 aligned in the cross direction KY. The printer controller 100, when acquiring the chip ID 302A from the IC chip 300, causes the carriage 52 to move in the cross direction KY, and acquires the chip ID 302A from the IC chip 300 of the ink cartridge 20 that moved along with movement of the carriage 52 to the communication position TSI at which wireless communication is possible with the access unit 105.

According to the above configuration, even with the printer 1 of on-carriage type, the printer controller 100 can avoid acquiring the chip IDs 302A simultaneously from the plurality of IC chips 300. Accordingly, the printer controller 100 can be reliably prevented from acquiring the chip IDs 302A in a duplicated manner, and can reliably prevent the chip ID 302A and information from being led to a wrong corresponding relationship when associating information with the chip ID 302A, to thus properly administrate the plurality of IC chips 300. In addition, because of the proper administration of the plurality of IC chips 300, even with the printer 1 of on-carriage type, the printer controller 100 can properly execute processing related to the ink information IJ for each of the plurality of IC chips 300.

Note that the above-described embodiments merely represent one aspect of the present disclosure, and any variation and application are possible within the scope of the present disclosure.

For example, in the first embodiment described above, a configuration is exemplified in which the IC chip 300 is provided at the bottom face 230B, and the position at which the IC chip 300 is provided may be located at, for example, the side face 2312 without being limited to the bottom face 230B. Note that the access unit 105 is provided at a position that allows for wireless communication with the IC chip 300 depending on the positions at which the IC chip 300 is provided.

In addition, for example, in the first embodiment described above, a configuration is exemplified in which the blocking member 30 is provided for each of the ink cartridges 20. However, it suffices that the blocking member 30, when the chip ID 302A and the ink information IJ are acquired, have a configuration in which the IC chip 300 and the access unit 105 can perform wireless communication with each other in a one-to-one manner, where the number of the blocking members 30 included in the printer 1 is, but not limited to, four. It also suffices that the shapes and arrangement of the blocking members 30 and the aspect of blocking by the blocking members 30 be configured such that the IC chip 300 and the access unit 105 can perform wireless communication with each other in a one-to-one manner when the chip ID 302A and the ink information IJ are acquired, without being limited to the configuration illustrated in FIG. 5.

Further, for example, in the above-described embodiments, the configuration is exemplified in which the IC chip 300 is provided outside the ink cartridge 20, a configuration may be employed in which the IC chip 300 is provided inside the ink cartridge 20.

Further, for example, in the above-described embodiments, the colors of the ink discharged from the ink jet head 53 is described as four colors of cyan, magenta, yellow, and black, and the colors of the ink discharged from the ink jet head 53 may be further more or less than four. Further, the nozzle rows as provided is not limited to four rows. Further, the number of the ink cartridges 20 that can be held by the printer 1 may be further more or less without being limited to four.

Further, for example, when the above-described method for controlling the printer 1 is enabled by using a computer included in the printer 1 or an external apparatus coupled to the printer 1, it is also possible to configure the present disclosure by aspects of a program executed by the computer to enable the above method, a storage medium configured to store the program in a computer readable manner, or a transmission medium configured to transmit the program.

Further, although a case is exemplified in which a function of the printer controller 100 is enabled by one unit of the processor 110, the function may be enabled by a plurality of processors or semiconductor chips.

Moreover, for example, the processing units illustrated in FIGS. 7 and 9 are obtained by being divided depending on processing mainly executed in the unit to make the processing easily recognizable. Thus, the present disclosure is not limited by how the processing units are divided and what the processing units are named. The processing units may be divided into further more number of processing units depending on the processing mainly executed in the unit, and may be divided such that a single processing unit includes further more number of processings. Further, the processing order may be replaced as appropriate within a range that does not violate the gist of the present disclosure.

Further, each of the functional units illustrated in FIG. 6 indicates a functional configuration, where a specific implementation configuration is not particularly limited. In other words, hardware that individually corresponds to each of the functional units is not necessarily implemented, and a configuration is possible as a matter of course in which a single processor executes a program to enable functions of a plurality of functional units. Further, in the above-described embodiments, some of the functions enabled by software may be configured by hardware, or some of the functions enabled by hardware may be enabled by software. In addition, specific detailed configurations of other components of the printer 1 may be modified as desired without departing from the gist of the present disclosure.

Moreover, for example, although in the above-described embodiments, the printer 1 is exemplified as a large format printer, the configuration of the printer is not limited as long as being an ink jet printer to which the ink cartridge 20 described above can be loaded.

What is claimed is:

1. A printer comprising:

an ink cartridge holding unit configured to hold a plurality of ink cartridges each including an ink storage section configured to store an ink and an information storage medium configured to store ink information about the ink stored in the ink storage section;

a wireless communication unit configured to perform wireless communication in a non-contact manner with the information storage medium of the ink cartridge held by the ink cartridge holding unit;

a wireless communication blocking unit configured to block wireless communication between the wireless communication unit and the information storage medium, the wireless communication blocking unit being disposed beneath the plurality of ink cartridges in the ink cartridge holding unit and being configured to move so as to be between the between the information storage medium and the wireless communication unit when blocking wireless communication and to not between the information storage medium and the wireless communication unit when not blocking wireless communication, and a controller configured to control the wireless communication unit, wherein the information storage medium is configured to store identification information that identifies the information storage medium, and the controller is configured to acquire, via the wireless communication unit, the identification information from the information storage medium of each of the plurality of ink cartridges held by the ink cartridge holding unit, and to execute, based on the identification information that is acquired, processing related to the ink information to the information storage medium of each of the plurality of ink cartridges via the wireless communication unit.

2. The device according to claim 1, wherein the controller is configured to perform, when acquiring the identification information from the information storage medium of each of the plurality of ink cartridges, wireless communication with the information storage media one by one via the wireless communication unit.

3. The printer according to claim 2, comprising the controller is configured to cause, when acquiring the identification information from the information storage medium, the wireless communication blocking unit to block wireless communication between the information storage medium other than an information storage medium from which the identification information is to be acquired and the wireless communication unit.

4. A printer comprising:

an ink cartridge holding unit configured to hold a plurality of ink cartridges each including an ink storage section configured to store an ink and an information storage medium configured to store ink information about the ink stored in the ink storage section;

a wireless communication unit configured to perform wireless communication in a non-contact manner with the information storage medium of the ink cartridge held by the ink cartridge holding unit;

a carriage configured to move in a cross direction crossing a transport direction in which a print medium is transported; and a controller configured to control the wireless communication unit, wherein the information storage medium is configured to store identification information that identifies the information storage medium, and the controller is configured to acquire, via the wireless communication unit, the identification information from the information storage medium of each of the plurality of ink cartridges held by the ink cartridge holding unit, and to execute, based on the identification information that is acquired, processing related to the ink information to the information storage medium of each of the plurality of ink cartridges via the wireless communication unit, wherein the carriage is provided with the ink cartridge holding unit, the ink cartridge holding unit holds a plurality of ink cartridges aligned in the cross direction, and the controller is configured to cause, when acquiring the identification information from the information storage medium, the carriage to move, and to acquire the identification information from the information storage medium of the ink cartridge that moved, along with movement of the carriage, to a position that allows for wireless communication with the wireless communication unit, the wireless communication unit being disposed on a medium support surface in a print region.

5. A method for controlling a printer, the printer including:

an ink cartridge holding unit configured to hold a plurality of ink cartridges each including an ink storage section configured to store an ink and an information storage medium configured to store ink information about the ink stored in the ink storage section;

a wireless communication unit configured to perform wireless communication in a non-contact manner with the information storage medium of the ink cartridge held by the ink cartridge holding unit;

a wireless communication blocking unit configured to block wireless communication between the wireless communication unit and the information storage medium, the wireless communication blocking unit being disposed beneath the plurality of ink cartridges in the ink cartridge holding unit and being configured to move so as to be between the between the information storage medium and the wireless communication unit when blocking wireless communication and to not between the information storage medium and the wireless communication unit when not blocking wireless communication, and a controller configured to control the wireless communication unit, wherein the information storage medium stores identification information that identifies the information storage medium, and the controller acquires, via the wireless communication unit, the identification information from the information storage medium of each of the plurality of ink cartridges held by the ink cartridge holding unit, and executes, based on the identification information that is acquired, processing related to the ink information to the information storage medium of each of the plurality of ink cartridges via the wireless communication unit.

* * * * *